United States Patent [19]

Kratt

[11] 3,988,798

[45] Nov. 2, 1976

[54] SELF ADJUSTING BRUSH ARM ASSEMBLY

[76] Inventor: Henry J. Kratt, 6633 S. Birmingham, Tulsa, Okla. 74136

[22] Filed: July 16, 1975

[21] Appl. No.: 596,230

[52] U.S. Cl. ..... 15/88

[51] Int. Cl.[2] ..... B08B 9/02

[58] Field of Search ..... 15/88, 104.04; 118/DIG. 11

[56] References Cited

UNITED STATES PATENTS

| | | | |
|---|---|---|---|
| 1,901,247 | 3/1933 | Kinzbach | 15/88 |
| 2,307,449 | 1/1943 | Carpmail | 15/88 |
| 3,495,288 | 2/1970 | Ford | 15/88 |

*Primary Examiner*—Edward L. Roberts

[57] ABSTRACT

A self adjusting brush arm assembly comprising a brush, a brush holder bracket extended into a tension bracket, the said tension bracket being connected to a spring spool by a NEG'ATOR spring, the said spring spool being assembled and mounted on a stationary bracket, the said stationary bracket being attached to a sprocket; a first and second pair of movable web members, said first and second movable web members being mounted between the said brush holder bracket and the said stationary bracket.

4 Claims, 3 Drawing Figures

SELF ADJUSTING BRUSH ARM ASSEMBLY

BACKGROUND OF THE INVENTION

The use of devices to increase the pressure applied to the outer surface of pipe through cleaning brushes has been known for sometime. The patent issued to A. B. Carpmail, U.S. Pat. No. 2,353,125 on July 11, 1944 discloses a pipe cleaning apparatus with a three brush assembly having spring means to maintain, decrease and increase the pressure of the cleaning brush 50, FIG. 3 against pipe surface 32. In this particular disclosure is shown a spring 18 mounted on a threaded shaft 19, the tension in the spring 18 being adjustable by moving nut 23 to a new position. This type of spring arrangement is not desirable because the tension in the spring 18 will vary as the size of the pipe is changed. To maintain a constant brush pressure on the surface of the pipe would require a constant adjustment by repositioning nut 23. This is not only an inaccurate measurement of pressure against the pipe surface but also requires considerable loss of time in adjusting the spring tension as the size of the pipe is changed. It is also difficult to maintain consistent equal pressures on the pipe surface at all the brush stations.

The U.S. Pat. No. 2,427,129 issued to D. A. Fields on Sept. 9, 1947 like the Carpmail U.S. Pat. No. 2,353,125 previously disclosed shows in FIG. 3 the use of spring 42 to maintain pressure by the cleaning devices against the outer surface of the pipe. This spring requires adjustment to maintain proper pressure against the pipe when the size of the pipe is changed similar to the disclosure in the Carpmail U.S. Pat. No. 2,353,125.

SUMMARY OF THE INVENTION

To alleviate the difficulties of maintaining equal pressure by the cleaning brushes against the outer pipe surface in the pipe cleaning assembly, I have invented a new and improved apparatus in which the cleaning brush pressure against the surface of the pipe is constant, uniform and the brush surfaces are tangentially centered under all conditions of operation regardless of the size of the pipe. By maintaining constant pressure against the outer surface of the pipe the cleaning of scale and deposit can be accomplished more thoroughly and the cost of labor which is required by constantly adjusting the spring tension for the different sizes of pipe against the brush holder in the field is eliminated. For the purposes of this invention the use of scraping and cleaning devices such as knife blades are considered equivalent to the use of cleaning brushes.

OBJECTS OF THE INVENTION

The object of this invention is to provide a brush assembly in a pipe cleaning machine in which the tangential pressure of the cleaning brush against the pipe surface remains constant without adjustment regardless of the size of the pipe being cleaned.

Another object of this invention is to provide a brush assembly in a pipe cleaning machine which will remove rust, scale and dirt from the surface of pipe without embedding the rust and scale into the pores of the cleaned metal surface of pipe.

Still another object of this invention is to provide means for providing a brush assembly for cleaning pipe wherein the brush metallic fiber structure remains positioned tangentially to the pipe surface thus providing more uniform wear of the metallic fiber structure of the cleaning brush.

And still another object of this inventon is to provide a brush assembly structure employing a NEG'ATOR spring to maintain constant pressure on the pipe surface.

Figure 1:
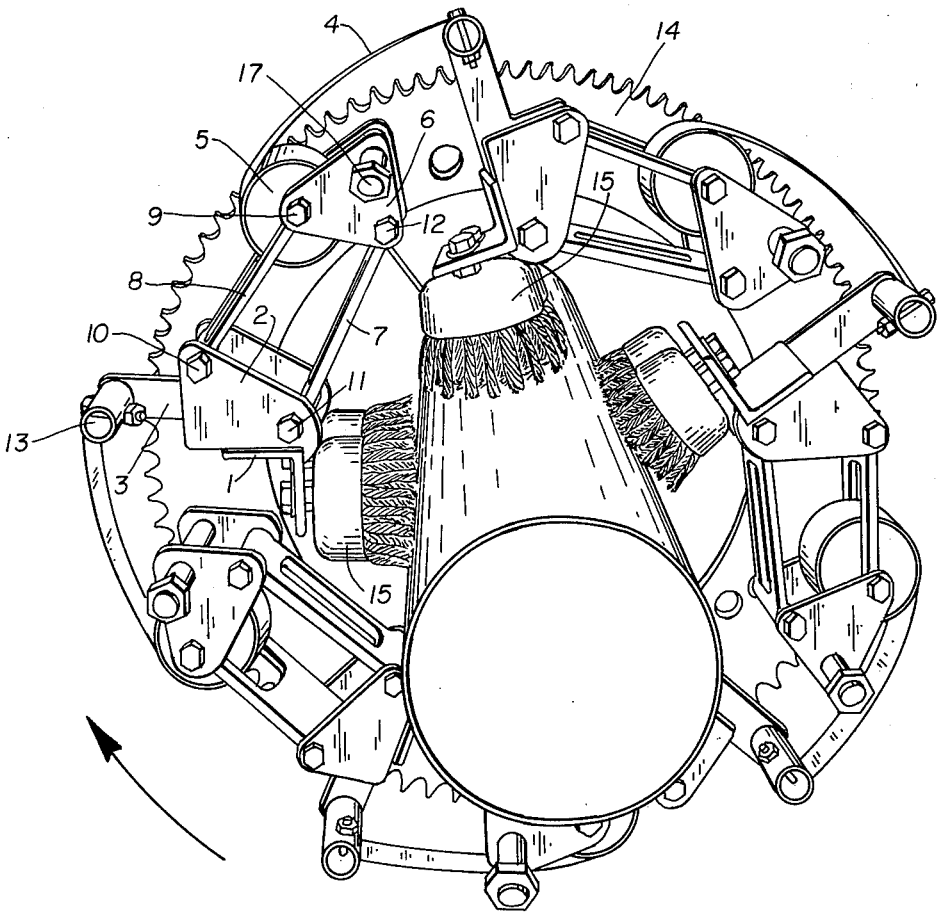
FIG. 1 is an isometric drawing of that part of a pipe cleaning machine showing the self adjusting brush arm assembly.

Reference is made to FIG. 1 which shows the complete self adjusting brush assembly. To properly coordinate the operation of the improved self adjusting brush assembly in a typical pipe cleaning machine it will be necessary to partially explain the operation and structure of a pipe cleaning machine. The pipe cleaning machine is useful on pipeline operation to clean the pipe surfaces in a preparation for coating and covering the pipe surface to preserve the pipe. In this particular type of pipe cleaning machine the cleaning brush assemblies 15, FIG. 1 are attached to a sprocket 14, FIG. 1, which is powered to move in a circular direction around the surface to be cleaned. The surface area to be cleaned is moved laterally pass the brush cleaning assemblies to clean and prepare the surface for coating.

Figure 3:
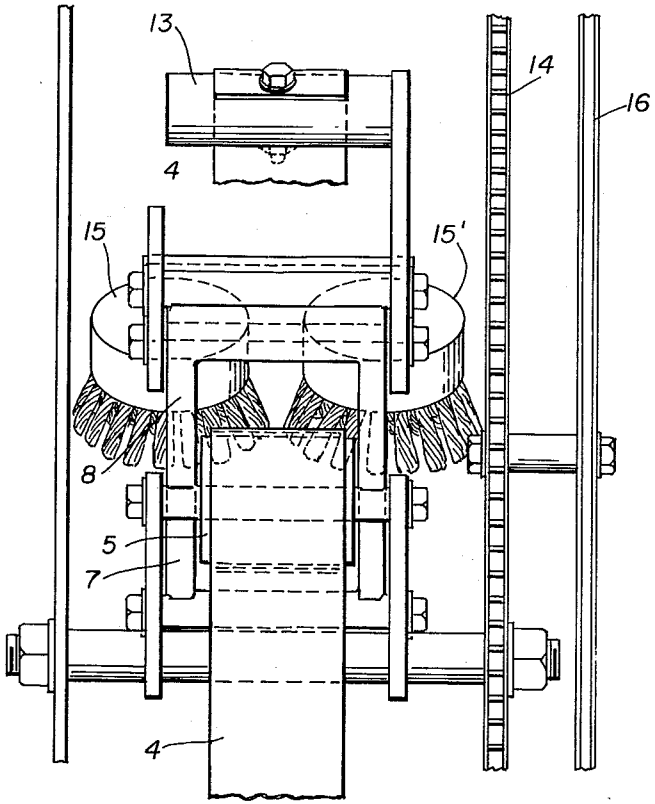
FIG. 3 is a drawing showing the top view of the self adjusting brush assembly.

The sprocket 14, FIG. 3, is mounted in a steel frame (not shown) and is geared to and driven by a gasoline engine (not shown). The sprocket 14 and related structure, FIG. 1, of the self adjusting brush assembly, FIG. 2, moves in a circular path around the circumference of the cylindrical surface being cleaned. The cleaning brushes 15, FIG. 2, by an abrasive action clean the surface of the cylindrical surface removing dirt, rust and corrosion.

Figure 2:
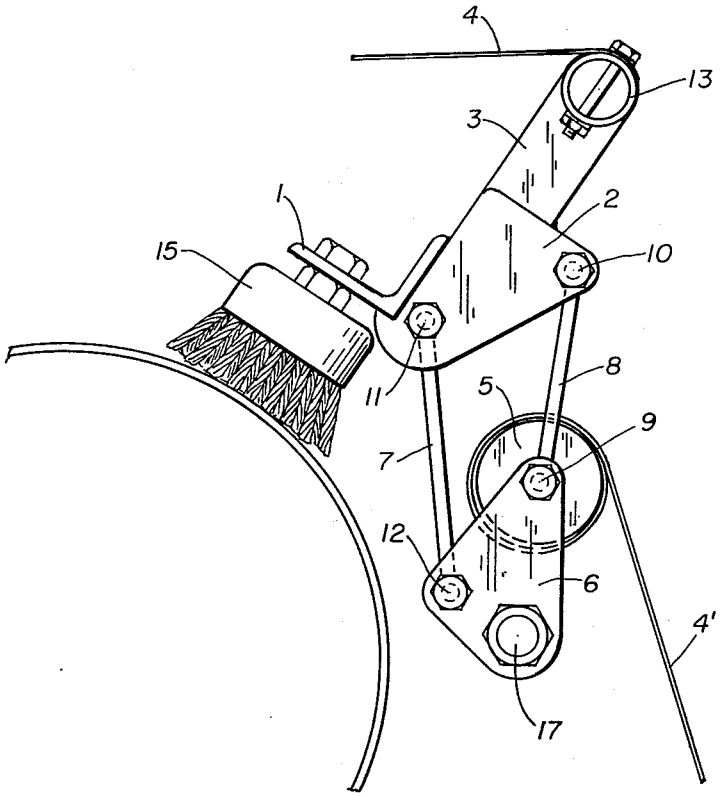
FIG. 2 is a line drawing showing the side view of the self adjusting brush assembly against the pipe surface.

FIG. 1 shows five self adjusting two brush units, as shown in FIGS. 1 & 2, assembled on sprocket 14 which is the preferred embodiment. However, the number of units assembled is a matter of choice and can be increased or decreased depending on the need. Each of the brush units disclosed herein contains two brushes mounted on a brush holder 1 which is attached to a movable bracket 2. Movable bracket 2 is extended into tension bracket 3 which is useful for mounting one end of the NEG'ATOR spring 4 with a curved surface.

The word NEG'ATOR is a registered trademark of Ametek Corporation, whose address is Hatfield, Pennsylvania and is used to identify the type of spring used in my invention.

The NEG'ATOR spring 4 extends from a bolt connection at position 13 on the first bracket extension 3 to a spring spool 5 on which the NEG'ATOR Spring 4 is spirally mounted. Spring spool 5 is mounted on a circular rod at position 9, FIG. 1, the circular rod extending between the two face plates of a second bracket 6. The second bracket 6 is connected in a fixed position to the sprocket 14 by bolt 17. The first bracket 2 and the second bracket 6 are connected together by a first and second web member 7 & 8, respectively. Web member 7 is connected to a bracket 2 at position 11 and to bracket 6 at position 12. Web member 8 is connected to bracket 2 at position 10 and to bracket 6 at position 9. Positions 9 and 12 indicates the position of the first and second bolts in the bracket 6; positions 10 and 11 indicates the position of the first and second bolts in bracket 2.

FIG. 2 is a line drawing showing the tangential relationship of brush 15 to the pipe surface. The brush is removable from the brush holder bracket 1. Due to the flexability of the stainless steel NEG'ATOR spring 4 the brush 15 can be raised for easier accessability for replacement when necessary. NEG'Ator spring 4 can be easily changed by removing the spring from the spring spool 5 and disconnecting the other end of the NEG'ATOR spring at position 13, since the NEG'ATOR spring 4 is unattached to spring spool 5 so that it fits and slides easily over the spring spool 5. The brush 15 is tangetially centered at all times due to difference in the lengths of web members 7 & 8 which move freely between the stationary bracket 6 and the movable bracket 2.

Reference is made to FIG. 3 which shows a partial top view looking down on the brush assembly. Brushes 15 and 15′ shown mounted in the assembly FIG. 3. Web members 7 & 8 are shown in position in the brush assembly FIG. 3 extending between brackets 2 and 6 as shown in FIG. 1. Spring spool 5 is shown positioned and mounted between face plates of bracket 6 with NEG'ATOR spring 4 spirally wound around spring spool 5 as shown in FIG. 1. Bracket 2, FIG. 1 is shown extended so as to provide fastening means 13 for the NEG'ATOR spring 4 as shown in FIG. 1.

It is my intention to include within the preview of my disclosure such modification which would be obvious to carry out the spirit of this invention as fall within the terms or spirit of the following claims:

I claim:

1. In a pipe cleaning machine, in combination, a sprocket having an opening for the passage of a pipe therethrough and with at least a first and second brush arm assembly mounted on the said sprocket;

a. each of the said first and second brush arm assemblies comprising a first movable bracket and second bracket, b. the said first movable bracket having support means for at least one cleaning brush suitable for removing rust and scale from pipe surfaces, 1. the said first bracket having a first and a second bolt extending through the face surfaces of the said first movable bracket to furnish support means for a first and a second movable web member, 2. the said first and second bolts being positioned at each of two corners of the said first movable bracket, 3. the said first bracket having an extension attached thereto with fastening means for securing one end of a curved surfaced spring in an extended position from the said first brush arm assembly to the said second brush arm assembly, the said spring furnishing constant pressure on the said cleaning brush, c. the said second bracket being attached to the said sprocket by means of a circular rod, 1. the said second bracket having two face plates spaced apart from each other and held in spaced relationship by the said circular rod, a first bolt and a second bolt, 2. the said circular rod, the first and second bolts being positioned at each of the corners of the said face plates, 3. the said first bolt providing support means for a rotatable spring spool positioned between the said two face plates, the said spring spool having the said curved surfaced spring spirally wound on the said spring spool, the said curved surfaced spring extending to the said fastening means in the said first bracket, 4. the said first and second bolts in the said second bracket each supporting the said first and second movable web member respectively, the said web members extending to the said first bracket and providing connection means between the said second bracket and the said first bracket in each of the said brush arm assemblies.

2. The brush arm assemblies as claimed in claim 1 where the length of the said first web member is shorter than the length of the second web member.

3. The brush arm assemblies as claimed in claim 1 where the said cleaning brush is detachably mounted to the said first movable bracket.

4. The brush arm assemblies as claimed in claim 1 where at least two cleaning brushes are attached to the said support means in the said first movable bracket.

* * * * *